United States Patent [19]

Magyar

[11] 4,358,879

[45] Nov. 16, 1982

[54] SEAT BELT BUCKLE

[75] Inventor: Joseph J. Magyar, Rochester, Mich.

[73] Assignee: General Motors Corporation, Detroit, Mich.

[21] Appl. No.: 211,632

[22] Filed: Dec. 1, 1980

[51] Int. Cl.[3] ..... A44B 11/25

[52] U.S. Cl. ..... 24/230 A

[58] Field of Search ..... 24/230 A, 230 AK, 230 AL, 24/230 AP

[56] References Cited

U.S. PATENT DOCUMENTS

| | | | |
|---|---|---|---|
| 3,895,196 | 7/1975 | Lewis | 200/61.58 B |
| 4,065,836 | 1/1978 | Stephenson | 24/230 A |
| 4,068,354 | 1/1978 | Loomba et al. | 24/230 A |
| 4,094,046 | 6/1978 | Takada | 24/230 AK |
| 4,136,425 | 1/1979 | Esher | 24/230 A |

FOREIGN PATENT DOCUMENTS

| | | | |
|---|---|---|---|
| 2730003 | 1/1979 | Fed. Rep. of Germany . | |
| 2807575 | 8/1979 | Fed. Rep. of Germany | 24/230 A |
| 2002444 | 2/1979 | United Kingdom . | |

*Primary Examiner*—Gene Mancene
*Assistant Examiner*—Robert P. Swiatek
*Attorney, Agent, or Firm*—Charles E. Leahy

[57] ABSTRACT

A seat belt buckle includes a housing having a pivotally mounted detent movable between a latched position in which a latch tab on the detent is inserted into an aperture in a latch plate and an unlatched position permitting latch plate entry and exit from the buckle. The detent is biased to the unlatched position by a detent spring. A keeper is slidably movable on the housing between an extended position overlying the detent to block detent movement to the unlatched position by inertia forces and a retracted position permitting detent movement to the unlatched position. An end depress pushbutton is slidably mounted on the housing for extension by a spring and retraction by the seat occupant depressing the pushbutton. Pushbutton retraction retracts the keeper from blocking the detent so the detent spring moves the detent to the unlatched position. Mating abutments on the keeper and detent maintain the keeper in the retracted position while the detent spring holds the detent in the unlatched position so that a subsequent entry of the latch plate into the buckle may be accomplished without the added effort necessary to move the detent out of the way. The pushbutton spring returns the pushbutton to the extended position subsequent to each retraction. A flexure element attached to the detent extends into the path of latch plate entry and pivots the detent to the latched position simultaneous with arrival of the latch plate at the fully inserted position within the buckle.

2 Claims, 6 Drawing Figures

SEAT BELT BUCKLE

The invention relates to a seat belt buckle and more particularly to a new and improved seat belt buckle of the type having an end depress pushbutton.

BACKGROUND OF THE INVENTION

It is well known in motor vehicles to provide an occupant restraint belt for the restraint of the occupant. Such seat belts typically include a first seat belt segment mounted on one side of the seat and having an apertured latch plate attached to the end thereof. A second belt segment is mounted on the other side of the seat and carries a buckle having an opening in the end thereof to receive the apertured latch plate. The buckle includes a detent which is inserted in the aperture of the latch plate to latch the latch plate within the buckle. An occupant actuable pushbutton is provided to disengage the detent from the latch plate so that the belt can be unbuckled.

It is desirable in such seat belt buckles that the pushbutton project from the end face of the buckle adjacent the latch plate opening and be depressed into the housing to effect unlatching of the latch plate. It is also desirable that the pushbutton project from the buckle housing the same distance whether or not the latch plate is engaged in the housing. It is also desirable to provide an ejector within the buckle to insure ejection of the latch plate therefrom whenever the detent is moved to the unlatched position. Furthermore, it is desirable that the detent remain in the unlatched position subsequent to ejection of the latch plate from the buckle so that the effort required to insert the latch plate into the buckle is lessened by the amount which would otherwise be required to move the detent away from the latching position. It is also desirable to provide a seat belt buckle construction in which the latch plate detent is physically blocked in the latched position in a manner to prevent movement of the detent to the unlatching position by inertia forces acting on the vehicle body.

SUMMARY OF THE INVENTION

According to the present invention, a buckle housing has a detent pivotally mounted thereon for movement between a latch position inserting a latch tab of the detent into the latch plate aperture and an unlatched position permitting latch plate entry and exit from the buckle housing. The detent is biased to the unlatched position by a detent spring. A keeper is slidably mounted on the housing for movement between an extended position overlying the detent to block detent movement to the unlatched position by inertia forces and a retracted position permitting detent movement to the unlatched position by the detent spring. An end depress pushbutton is mounted on the housing for extension by a pushbutton spring and retraction by the occupant depressing the pushbutton. Retraction of the pushbutton retracts the keeper from blocking engagement with the detent so that the detent spring is permitted to move the detent to the unlatching position. Mating abutments on the keeper and the detent maintain the keeper in the retracted position while the detent spring maintains the detent in the unlatched position so that a subsequent entry of the latch plate into the buckle may be accomplished without the added effort necessary to move the detent out of the way. The pushbutton spring returns the pushbutton to the extended position subsequent to each retraction. A flexure element is attached to the detent and extends into the path of latch plate entry so that the latch plate engages the flexure element to pivot the detent to the latched position simultaneous with arrival of the latch plate at the fully inserted position within the buckle housing.

DESCRIPTION OF THE DRAWINGS

These and other objects, features, and advantages of the invention will become apparent upon consideration of the specification and the appended drawings in which.

DESCRIPTION OF THE PREFERRED EMBODIMENT

Figure 1:
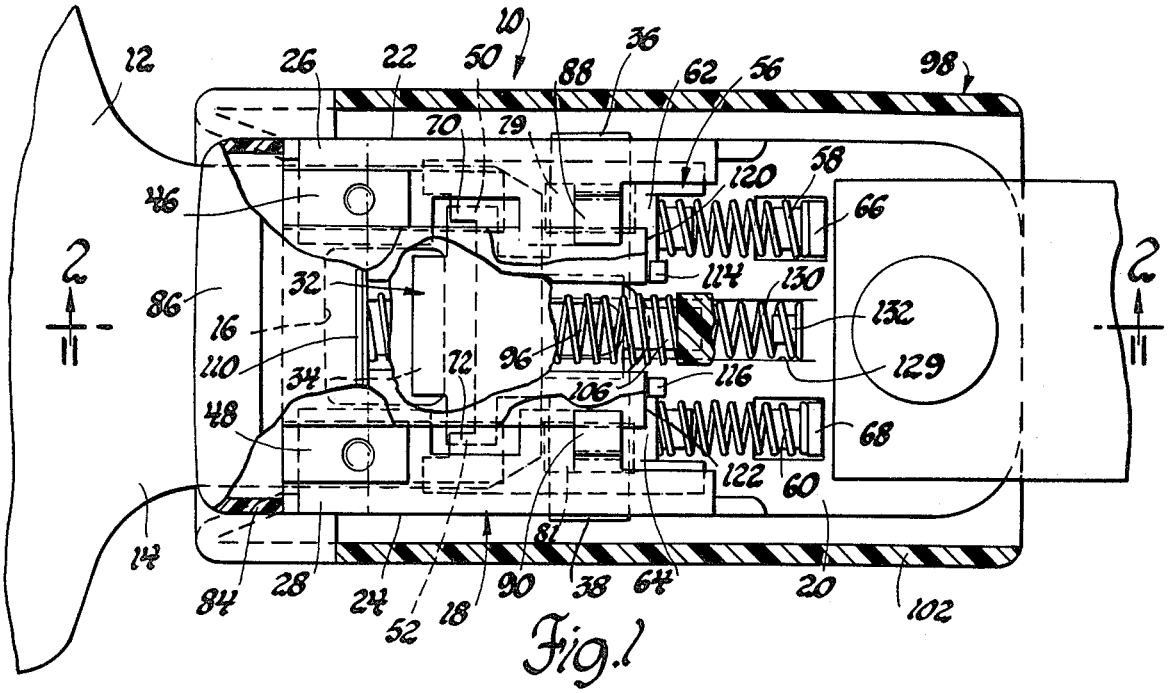
FIG. 1 is a plan view of the seat belt buckle and latch plate having parts cutaway and in section and showing the latch plate latched within the buckle housing.
Figure 2:
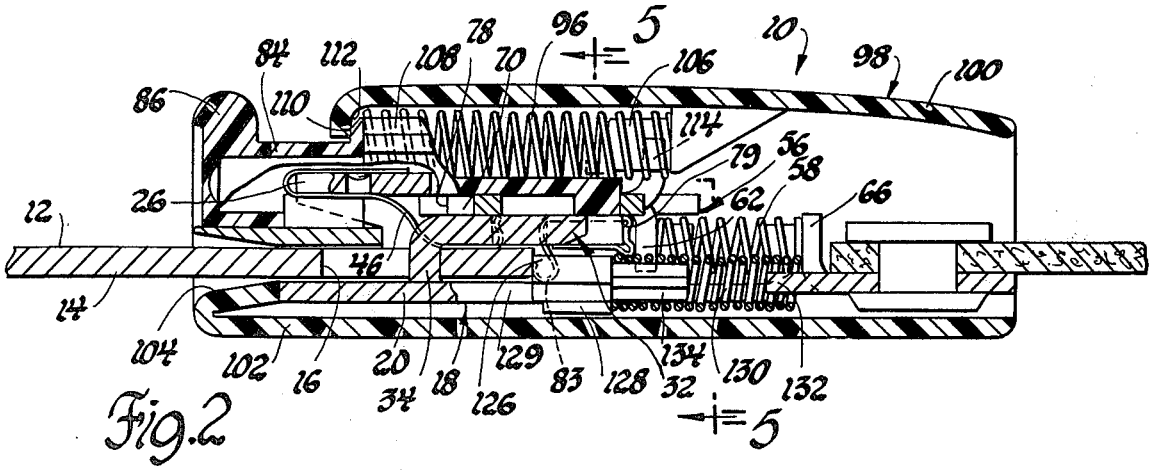
FIG. 2 is a sectional view through the buckle and latch plate taken in the direction of arrows 2—2 of FIG. 1.

Referring to the drawings, a buckle generally indicated at 10 mates with a latch plate 12. As best seen in FIGS. 1 and 2, the latch plate 12 includes an elongated tongue 14 having a rectangular aperture 16. The latch plate 12 is suitably attached to a length of seat belt, not shown.

Figure 5:
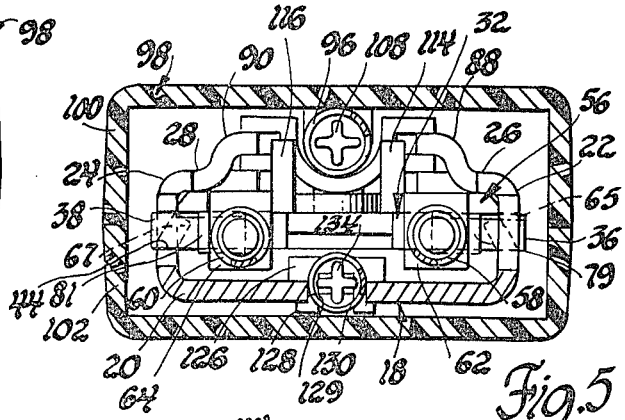
FIG. 5 is a sectional view taken in the direction of arrows 5—5 of FIG. 2.
Figure 6:
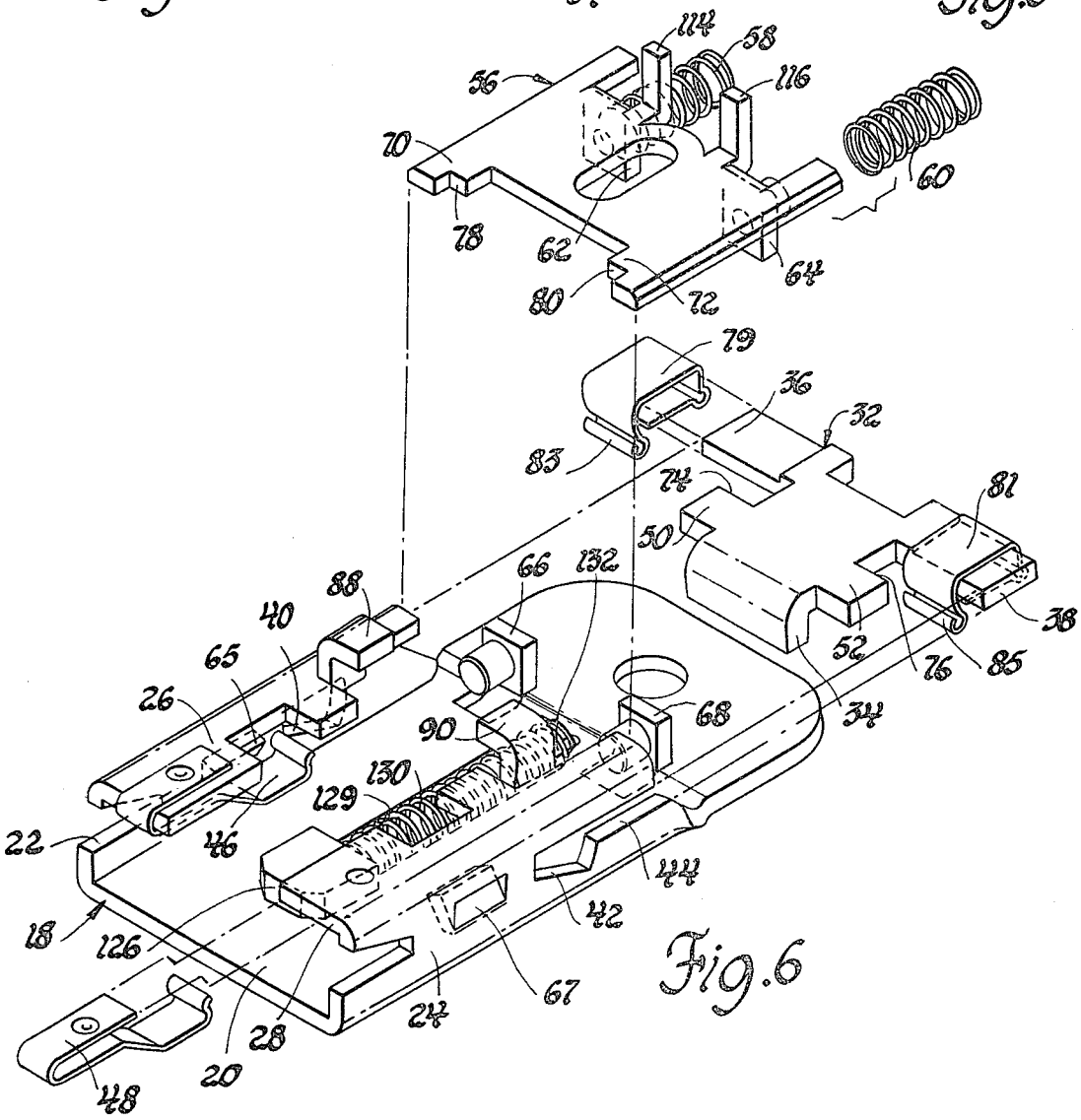
FIG. 6 is an exploded fragmentary perspective view of the buckle.

The buckle 10 includes a housing 18 of stamped steel including, as best seen in FIGS. 5 and 6 a base wall 20 and upturned walls 22 and 24 which have their upper ends turned inwardly to define flanges 26 and 28.

Figure 3:
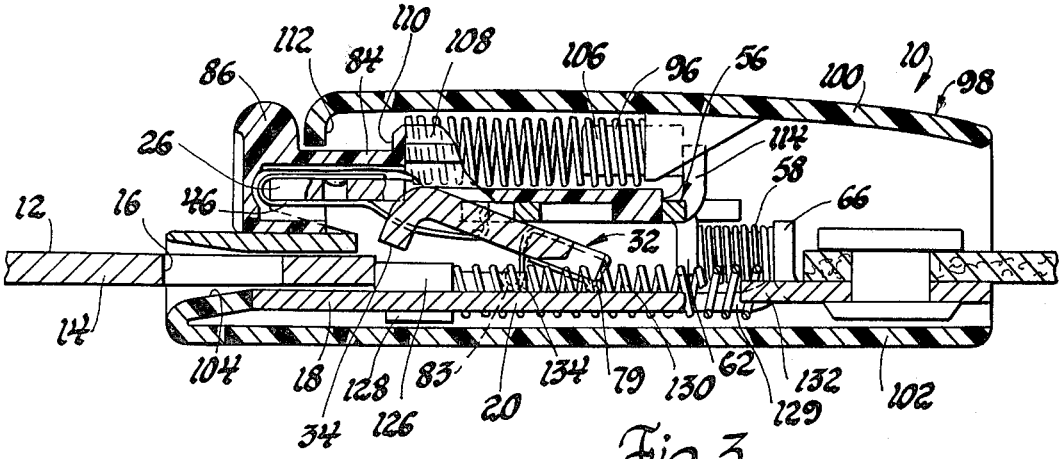
FIG. 3 is a view similar to FIG. 2 but showing the occupant depression of the push button, movement of the detent to the unlatched position, and ejection of the latch plate from the buckle.
Figure 4:
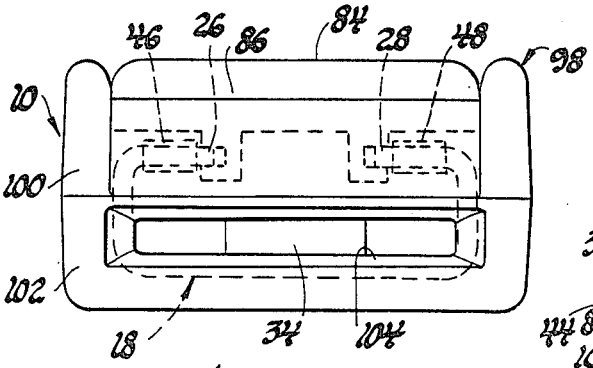
FIG. 4 is a view of an end of the buckle.

A detent 32 is mounted within the housing 18 and adapted to engage the latch plate 12. As best seen in FIG. 6, the detent 32 is of stamped steel and has a generally planar shape except for a downwardly bent latch tab 34 which is adapted to engage within the aperture 16 of the latch plate 12. The detent 32 has pivot arms 36 and 38 projecting laterally therefrom and extending into aligned triangular shaped apertures 40 and 42 provided respectively in the housing walls 22 and 24 to mount the detent 32 for pivotal movement between the latched position shown in FIG. 2 and an unlatched position shown in FIG. 3. The housing wall 24 has an entry slot 44 which permits assembly of the detent 32 into the housing 18. As best seen in FIGS. 3 and 6, a pair of detent springs 46 and 48 are snap mounted onto the housing flanges 26 and 28 and bear upwardly against lateral arms 50 and 52 provided on the detent 32 to bias the detent 32 upwardly to the unlatched position of FIG. 3.

As best seen in FIGS. 2 and 6, a keeper 56 is comprised of a generally planar sheet steel stamping and it is captured beneath the flanges 26 and 28 for longitudinal extending and retracting movement. The keeper 56 is biased to the extended position by a pair of keeper springs 58 and 60 which act respectively between downturned tabs 62 and 64 of the keeper 56 and upstruck tabs 66 and 68 of the housing 18. Each of the tabs 62, 64, 66, and 68 has a cylindrical projection suitably attached thereto for retaining and guiding the respectively associated keeper spring 58 and 60.

FIG. 2 shows the keeper 56 in the extended position in which the keeper overlies both the detent pivot arms 36 and 38 and the detent lateral arms 50 and 52 so that the detent 32 is blocked in the latched position in which the detent latch tab 34 extends within the aperture 16 of the latch plate 12. Tabs 65 and 67 are struck inwardly from the housing side walls 22 and 24 and bear against the underside of the keeper 56 to provide additional support for the longitudinal sliding movement of the keeper 56. FIG. 3 shows the keeper 56 moved to the retracted position in which the leading projections 70 and 72 of the keeper 56 are withdrawn from overlying the detent lateral arms 50 and 52 so that the detent springs 46 and 48 are permitted to move the detent 32 to the unlatched position of FIG. 3. Referring to FIG. 3, it is seen that the unlatched position of the detent 32 causes the rearward faces 74 and 76 of lateral arms 50 and 52 to align with the forward faces 78 and 80 of the keeper 56. Accordingly, the unlatched position of the detent 32 maintains the keeper 56 in its retracted position of FIG. 3 against the bias of the keeper springs 58 and 60.

Flexure clips 79 and 81 are snap-attached to the pivot arms 36 and 38 of the detent 32 and have spring legs 83 and 85 which project downwardly into the path of entry of the latch plate 12. Accordingly, the final stage of entry of the latch plate 12 into the buckle 10 causes engagement of the end of the latch plate 12 with the latch clip spring legs 83 and 85 to effect downward pivoting movement of the detent 32 from the unlatched position of FIG. 3 to the latched position of FIG. 2. The spring legs 83 and 85 are yieldable to forgive over insertion of the latch plate 12.

Referring to FIGS. 1 and 5, an injected molded plastic buckle cover 98, including an upper portion 100 and a lower portion 102, enclose the buckle housing 18 and define an entry opening 104 for the latch plate 12. An injection molded plastic pushbutton 84 is mounted for extending and retracting movement in the end of the buckle 10 adjacent the entry opening 104 for the latch plate 12. As best seen in FIG. 2, the pushbutton includes an end depress button portion 86 which projects outwardly of the buckle 10. A pair of retaining flanges 88 and 90 extend from the housing flanges 26 and 28 and interfit with mating slots provided in the edge faces of the pushbutton 84 to mount and guide the retracting and extending movement of the pushbutton 84. As best seen in FIG. 2, a pushbutton spring 96 has one end mounted on a projection 106 of the buckle cover 98 and the opposite end mounted on a cruciform projection 108 of the pushbutton 84. The pushbutton spring 96 urges extending movement of the pushbutton 84 to the FIG. 2 position in which an end surface 110 of the pushbutton seats against a flange 112 of the cover 98.

Referring to FIG. 6, the keeper 56 has a pair of upstruck arms 114 and 116 which project upwardly behind mating rear faces 120 and 122 of the pushbutton 84. Accordingly, as best seen in FIG. 3, retracting movement of the pushbutton 84 induced by occupant depression of the button portion 86 causes the rear end pushbutton rear faces 120 and 122 to retract the keeper 56 rearwardly to the position of FIG. 3 and allow concomittant upward movement of the detent 32 by the detent springs 46 and 48.

As best seen in FIGS. 2, 3, and 5, a molded plastic ejector 126 is supported for extending and retracting movement along the housing arm base wall 20 by a lower projection 128 thereof which extends into an elongated slot 129 provided in the base 20. An ejector spring 130 has one end seated on a tab 132 of the base 18 and its other end engaged on a cruciform projection 134 of the ejector 126 to urge movement of the ejector 126 from the retracted position of FIG. 2 to the extended position of FIG. 3.

OPERATION

FIG. 3 shows the latch plate 12 at a position corresponding to an initial state of entry into the opening 104 of the buckle 10. The leading edge of the latch plate 12 engages the ejector 126 and retracts the ejector to the retracted position of FIG. 2.

As best seen in FIG. 2, the final stage of insertion of the latch plate 12 into the buckle opening 104 causes the end of the latch plate 12 to engage with the spring legs 83 and 85 of the flexure clips 79 and 81 so that the final insertion motion of the latch plate 12 pivots the detent 32 downwardly from the unlatched position of FIG. 3 to the latched position of FIG. 2 in which the detent latch tab 34 is inserted within the aperture 16 of latch plate 12. The downward pivoting movement of the detent 32 withdraws the rearward faces 74 and 76 thereof away from engagement with the forward faces 78 and 80 of the keeper 56 so that the keeper springs 58 and 60 are permitted to extend the keeper 56 to the position of FIG. 2 in which the forward projections 70 and 72 of the keeper overlie the detent lateral arms 50 and 52 of the detent 32 to block the detent in the latched position of FIG. 2. The manner in which the keeper 56 overlies the detent 32 provides effective blocking of the detent 32 against movement to the unlatched position by inertia forces experienced by the vehicle.

The buckle is unlatched by the occupant depressing the button portion 86 to move the pushbutton 84 to the retracted position of FIG. 3. The retracting movement of the pushbutton 84 causes its rear faces 120 and 122 to engage in the arms 114 and 116 of the keeper 56 and thereby retract the keeper as shown in FIG. 3. Rearward movement of the keeper leading projections 70 and 72 out of overlying relationship with the detent lateral arms 50 and 52 permit the detent springs 46 and 48 to pivot the detent 32 upwardly to the unlatched position of FIG. 3. Accordingly, the detent tab 34 is withdrawn from insertion in the latch plate aperture 16 so that the ejector 126 propelled by the ejector spring 130 ejects the latch plate 12 from the buckle 10. FIG. 3 shows the pushbutton 84 retracted into the housing. However, it will be appreciated that the pushbutton spring 96 will always act to return the pushbutton 84 to the extended position of FIG. 2 whenever the occupant releases the pushbutton.

While this invention has been disclosed primarily in terms of specific embodiment shown in the drawings, it is not intended to be limited thereto but rather only to the extent as set forth in the appended claims.

The embodiment of the invention in which an exclusive property or privilege is claimed are defined as follows:

1. A buckle adapted for selective engagement with an apertured latch plate comprising:

a housing adapted to slidably receive the apertured latch plate;

a detent having a latch tab;

pivot means mounting the detent on the housing for pivotal movement between a latched position inserting the latch plate tab in the latch plate aperture and an unlatched position permitting latch plate entry and exit;

spring means biasing the detent to the unlatched position;

a keeper slidably movable on the housing between an extended position overlying the detent to block detent movement to the unlatched position and a retracted position permitting detent movement to the unlatched position;

a pushbutton slidably mounted on the housing for extension and retraction and adapted to retract the keeper upon pushbutton retraction so that the keeper is retracted from blocking engagement to the detent;

spring means returning the pushbutton to the extended position subsequent to each retraction;

abutment means acting between the keeper and the detent to maintain the keeper in a retracted position when the detent is in the unlatched position; and flexure means attached to and extending from the detent into the path of latch plate entry so that the latch plate engages the flexure means to pivot the detent to the latched position.

2. A buckle adapted for selective engagement with an apertured latch plate comprising:

a housing adapted to receive the apertured latch plate;

a detent having a latch tab adapted to engage within the latch plate aperture;

pivot means mounting the detent on the housing for pivotal movement between a latched position inserting the latch tab in the latch plate aperture and an unlatched position permitting latch plate entry and exit;

spring means biasing the detent to the unlatched position;

flexure means attached to and extending from the detent into the path of latch plate entry so that the latch plate engages the flexure means to pivot the detent to the latched position;

a keeper slidably movable on the housing between an extended position overlying the detent to block detent movement to the unlatched position and a retracted position permitting detent movement to the unlatched position;

keeper spring means urging the keeper to the extended position so that the detent is maintained in the latched position;

a pushbutton slidably mounted on the housing for extension and retraction and adapted to engage the keeper and retract the keeper upon pushbutton retraction so that the keeper is retracted from blocking engagement of the detent to permit detent movement to the unlatched position;

spring means returning the pushbutton to the extended position subsequent to each retraction irrespective of the position of the keeper; and abutment means provided respectively on the keeper and the detent and engageable with one another when the keeper is retracted and the latch is unlatched so that the keeper is maintained in the retracted position.

* * * * *